US005148356A

United States Patent [19]

Freese et al.

[11] Patent Number: 5,148,356

[45] Date of Patent: Sep. 15, 1992

[54] CRIB LIGHT

[75] Inventors: T. Brent Freese, Westminster; Joseph E. Janicke, Eldorado Springs, both of Colo.

[73] Assignee: Gerry Baby Products Company, Denver, Colo.

[21] Appl. No.: 753,094

[22] Filed: Aug. 30, 1991

[51] Int. Cl.[5] ..... A47B 23/06

[52] U.S. Cl. ..... 362/130; 362/277; 362/319; 362/368; 362/801

[58] Field of Search ..... 362/130, 127, 807, 277, 362/319, 368; 446/227

[56] References Cited

U.S. PATENT DOCUMENTS

| | | | |
|---|---|---|---|
| 1,739,337 | 12/1929 | Von Canon et al. | 362/130 |
| 2,406,029 | 8/1946 | Nettesheim | 362/130 |
| 3,840,924 | 10/1974 | Hamilton | 362/130 |
| 4,231,030 | 10/1980 | Weiss | 362/130 |
| 4,432,044 | 2/1984 | Lautzenheiser | 362/223 |
| 4,473,871 | 9/1984 | Fuchshuber | 362/802 |
| 4,594,072 | 6/1986 | Cowell | 446/227 |
| 4,872,095 | 10/1989 | Dubak et al. | 362/802 |
| 5,057,051 | 10/1991 | Babicz | 446/227 |

FOREIGN PATENT DOCUMENTS

| | | | |
|---|---|---|---|
| 435137 | 9/1935 | United Kingdom | 362/130 |

*Primary Examiner*—Allen M. Ostrager
*Assistant Examiner*—Sue Hagarman
*Attorney, Agent, or Firm*—Biebel & French

[57] ABSTRACT

A crib light is provided having front and rear housing portions which cooperate to clamp the light to a horizontal rail of a crib. The rear housing portion may be removed to permit the front housing portion to be mounted flush to a vertical wall surface. In addition, a lens cover is provided adjacent to a light emitting aperture of the front housing portion for controlling the brightness of light emitted and a control circuit is further provided for automatically shutting the light off after a predetermined interval of time.

12 Claims, 6 Drawing Sheets

12
134
148
130
14
128
16'
138

CRIB LIGHT

BACKGROUND OF THE INVENTION

The present invention relates to a light, and more particularly, to a light which may be attached to a crib or to a vertical wall surface.

Prior art crib lights are known which may be mounted to an upper rail of a crib. Such crib lights typically include some sort of clamping structure for removably attaching the crib light to the crib.

In one known crib light, the light includes a box-shaped housing which may be positioned against the vertical rails of the crib and a clamping plate is provided on an opposite side of the vertical rails with a screw passing through the clamping plate and into the housing to clamp the light in a vertical position. Such a clamping arrangement suffers from the disadvantage that any force applied to the light housing may dislodge the light such that the light could slide up or down along the rails.

In another prior art crib light, a horizontally extending support member is permanently affixed to the light housing for engaging the top surface of a crib rail to prevent the light from sliding downwardly. In addition, a spring loaded finger may be provided for engaging the crib rails on the opposite side from the light housing, or a screw tightenable clamping member may be provided for engaging the railing to thereby limit pivotal movement of the light housing relative to the horizontal support and the top rail. Such a light is limited in the environments in which it may be used since, in order to be mounted properly, it must be used in combination with the top rail of a crib.

Prior art crib lights also suffer from the disadvantage of having a light which does not permit adjustment of the brightness of the light emitted therefrom. Thus, turning the light on may result in waking a baby sleeping in a crib, contrary to the intended purpose of the light to provide only enough light to view a child in a crib without waking the child.

Accordingly, there is a need for a crib light which may be mounted adjacent to the top horizontal rail of a crib and which includes a clamping structure for immovably holding the light against movement relative to the rail. In addition, there is a need for such an immovably mounted light which may be also mounted to a vertical wall surface, such as may be required when the light is mounted adjacent to a changing table.

There is also a need for a crib light in which the brightness of the light emitted may be adjusted to avoid waking a child lying beneath the light or to provide sufficient light for performing tasks within a crib without the light hurting the child's eyes.

SUMMARY OF THE INVENTION

The present invention provides a light having a front housing portion which may be mounted either to the top rail of a crib or to a vertical wall surface. The front housing portion includes a substantially planar rear surface which may be mounted in facing contact to a wall surface and which is also adapted to receive a rear housing portion and clamping screw for mounting the light to an upper rail of a crib.

The light also includes a light source located within the front housing portion and means defining a light aperture in the front housing portion for permitting passage of light. A lens and a lens cover are located at the light aperture, with the lens cover being movable relative to the light aperture and lens such that movement of the lens cover operates to open and close the light aperture and thereby control the brightness of light emitted from the front housing portion.

The lens and lens cover each define a half cylindrical shape and the lens cover moves in pivotal movement about the lens. The lens includes an end wall and the lens cover also includes an end wall adjacent to the lens end wall. One of the end walls of the lens or lens cover includes means defining a semi-circular slot therein and the other of the end walls includes a tab extending into the slot such that the tab and slot cooperate to limit the movement of the lens cover relative to the lens.

The crib light of the present invention further includes an electrical power source and a switch and control circuit operating to control passage of electrical power from the power source to the light source. The switch is movable between first and second positions wherein positioning the switch in the first position turns the light off and movement of the switch into the second position turns the light on for a predetermined interval of time controlled by the control circuit.

It is therefore an object of the present invention to provide a light which may be mounted either to a crib or to a vertical wall surface.

It is a further object of the present invention to provide a crib light in which the brightness of the light emitted may be varied to adjust for different lighting requirements.

It is also an object of the present invention to provide a light which will shut off automatically after a predetermined interval of time whereby the electrical energy supplied by an electrical power source may be conserved.

Other objects and advantages of the invention will be apparent from the following description, the accompanying drawings, and the appended claims.

DETAILED DESCRIPTION OF THE PREFERRED EMBODIMENTS

Figure 1:
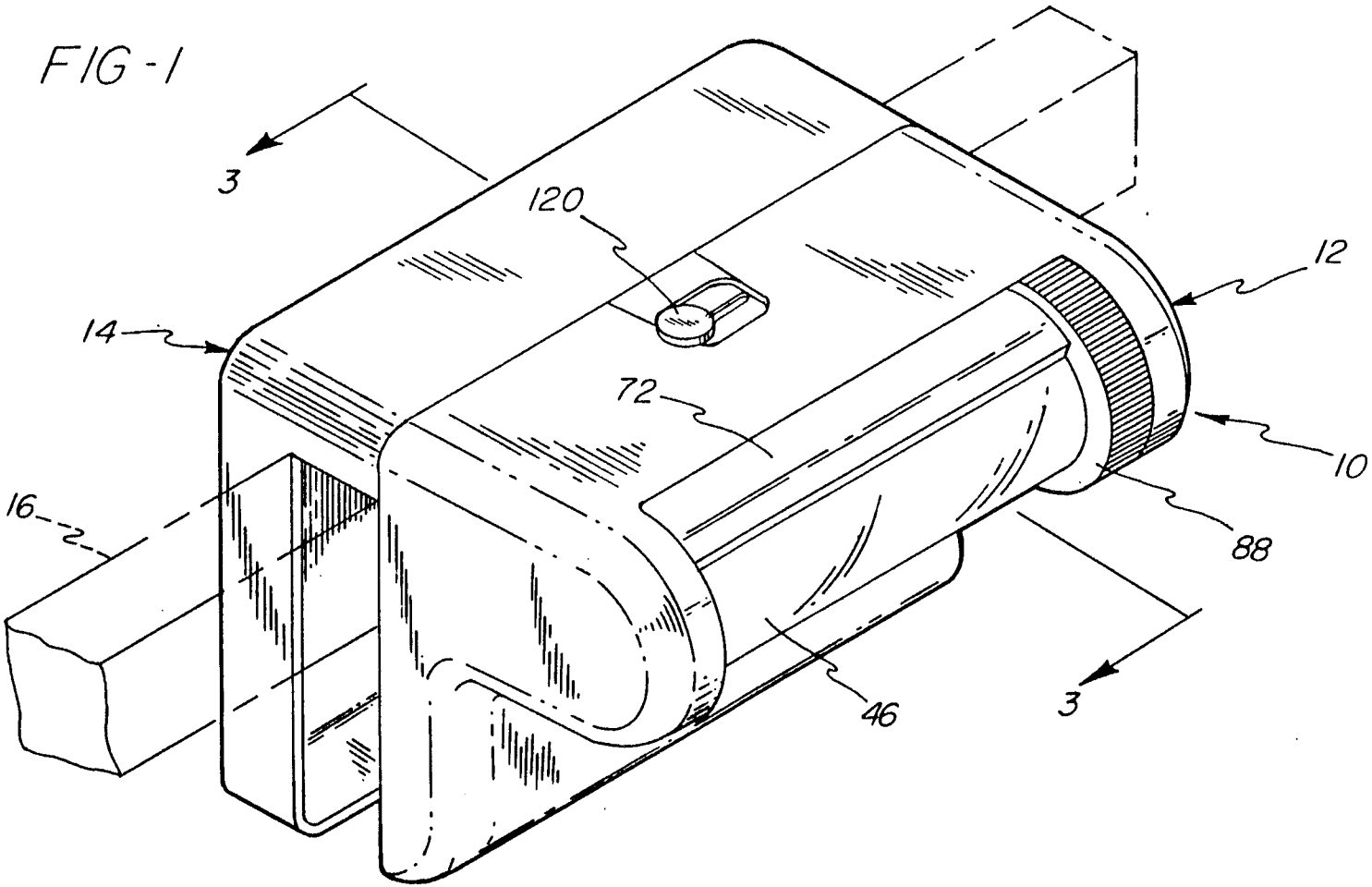
FIG. 1 is a perspective view of the crib light of the present invention depicted in position on the horizontal rail of a crib.

As may be seen in FIG. 1, the crib light 10 of the present invention includes a front housing portion 12 and a rear housing portion 14 wherein both the front and rear housing portions 12, 14 are preferably formed of molded plastic. The rear housing portion 14 is configured generally as an L-shaped element which cooperates with the front housing portion 12 to form a gap for receiving a horizontally oriented crib rail 16.

Figure 2:
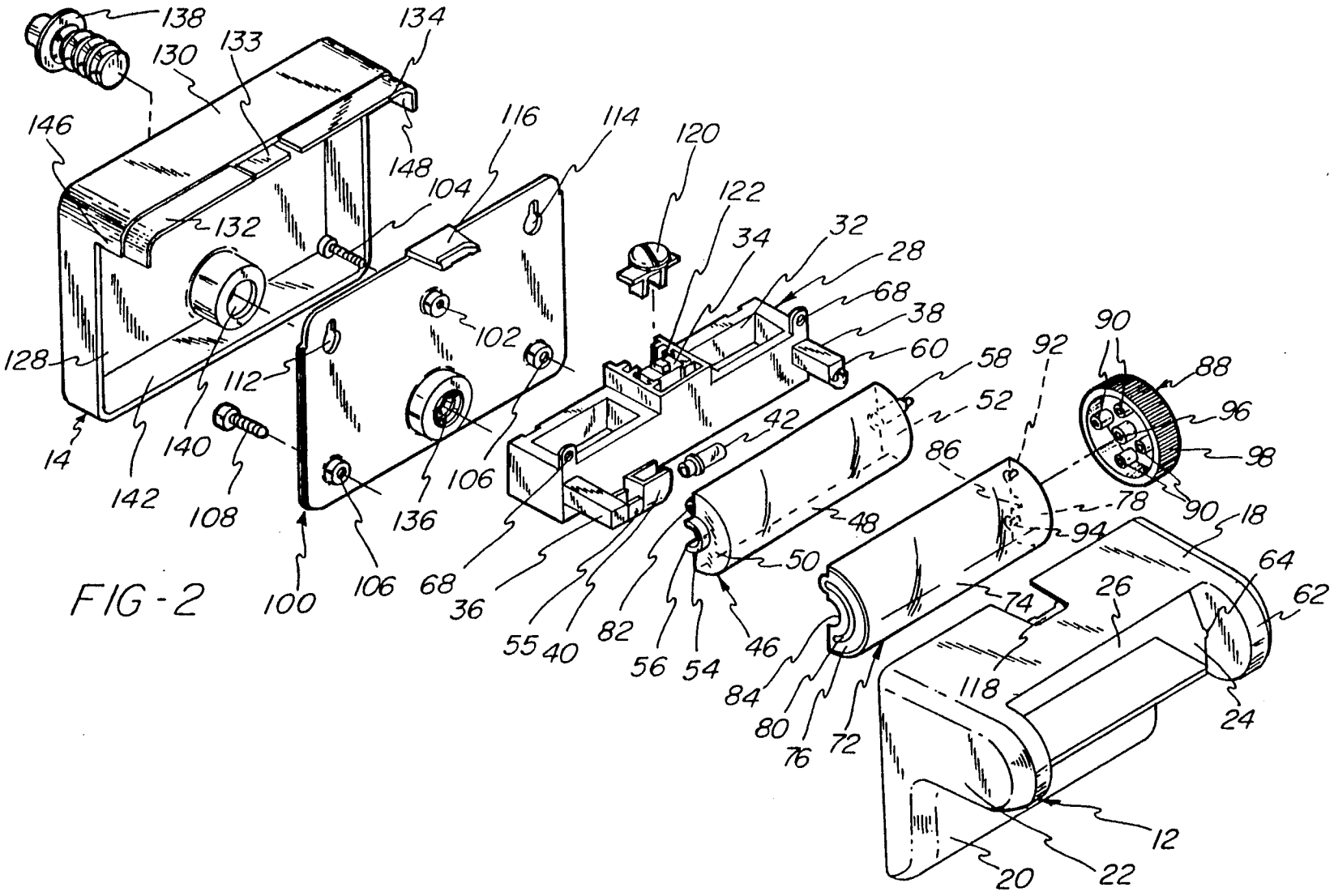
FIG. 2 is an exploded perspective view of the crib light assembly of the present invention.
Figure 3:
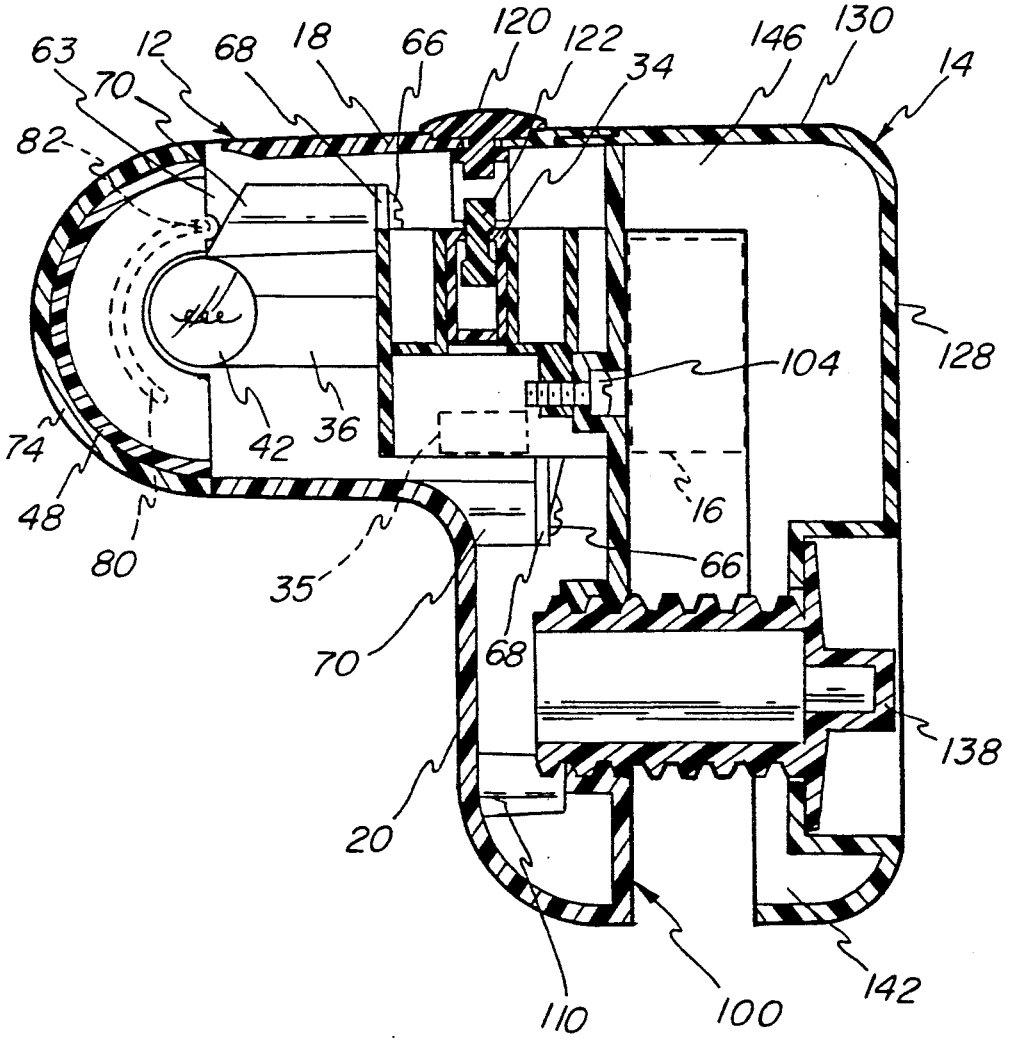
FIG. 3 is a cross-sectional elevational view taken along line 3—3 in FIG. 1.

The details of the component elements of the crib light 10 are shown in FIGS. 2 and 3. The front housing portion 12 is defined by an upper plate 18, a lower plate 20 and opposing first and second end plates 22, 24 (see also FIG. 4) connecting the upper and lower plates 18, 20.

A lens opening or aperture 26 is provided at a forward side of the front housing portion 12 and is defined between the end plates 22, 24. As is apparent from the drawings, the front housing portion 12 is formed as a generally L-shaped member wherein the vertical dimension of the front housing portion 12 is wider at the rearward side than at the forward side thereof.

A battery holder 28 is provided for positioning interiorly of the front housing portion 12. The battery holder 28 includes first and second battery compartments 30, 32 for containing batteries and a switch 34 positioned between the battery compartments 30, 32. In addition, a conventional control circuit 35 may be provided positioned within the battery holder 28 for purposes to be described further below.

A first support post 36 is formed integrally with the battery holder 28 and extends forwardly from the battery compartment 30 adjacent to the first end 22 of the housing 12. A second support post 38 is formed integrally with the battery holder 28 at an end thereof opposite from the first support post 36 and adjacent to the second end 24 of the front housing portion 12. The first support post 36 includes a light bulb holder 40 for receiving a light bulb 42.

A semi-cylindrical lens 46 formed of a translucent plastic material is supported by the first and second support posts 36, 38. The lens 46 includes a body portion 48 having a semi-circular cross-section defining a longitudinal axis of the lens 46, and first and second semi-circular lens end walls 50, 52 are attached to opposing ends of the body portion 48. A semi-circular sleeve 54 extends outwardly from the first lens end wall 50 along the longitudinal axis of the lens 46.

Figure 4:
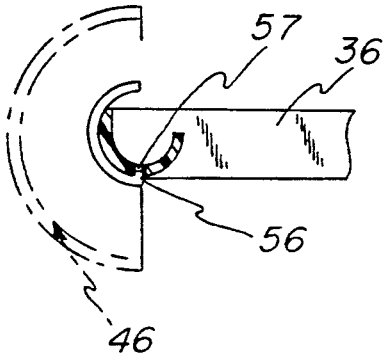
FIG. 4 is a cross-sectional view taken through the lens holder portion to show the lens tang engaging in the lens holder portion slot.

The sleeve member 54 is adapted to be received on a lens holder portion 55 located between the support post 36 and the light bulb holder 40 for supporting the lens 46 relative to the battery holder 28 and the front housing portion 12. As seen in FIG. 4, the sleeve 54 includes a radially inwardly extending tang 56 for engaging a slot 57 on a lower portion of the lens holder portion 55 in order to facilitate holding the lens 46 in immovable position relative to the support post 36.

Figure 5:
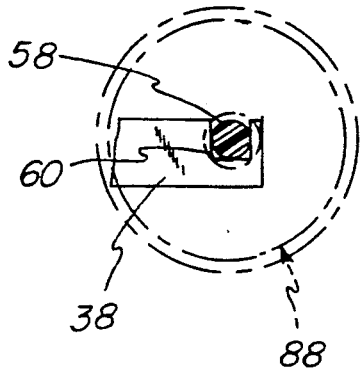
FIG. 5 is an elevational view showing the lens shaft supported in the slot formed in the second support post.

The second lens end wall 52 supports a longitudinally extending shaft 58. As seen in FIG. 5, the shaft 58 is supported in a slot 60 formed in the second support post 38. As may be seen in FIG. 2, the front housing portion 12 includes a lens positioning plate 62 having a slot 64 therein for engaging the shaft 58 to facilitate holding the second end of the lens 46 in position. Similarly, a lens positioning plate 63 (see FIG. 3) is provided at the opposite end of the housing 12 adjacent to end plate 22 for engaging a longitudinally outer edge of the sleeve 54 to facilitate holding the first end of the lens 46 in position adjacent to the first support post 36.

Referring to FIG. 3, it should be noted that the battery holder 28 may be attached to the front housing portion 12 in any conventional manner such as by a plurality of fasteners 66 extending through mounting tabs 68 formed on the battery holder 28 whereby the battery holder 28 may be attached to mounting posts 70 formed integrally with the front housing portion 12.

Referring to FIG. 2, a semi-cylindrical opaque lens cover 72 is provided for positioning over the lens 46 and includes a body portion 74 having a semi-circular cross-section and first and second semi-circular end walls 76, 78 attached to opposing ends of the body portion 74. The first lens cover end wall 76 includes means defining a semi-circular slot 80 therein for receiving a tab member 82 extending axially from the first lens end wall 50. In addition, the first lens cover end wall 76 is formed with a semi-circular cut-out portion 84 for engaging around the sleeve 54 to facilitate guiding movement of the lens cover 72 in pivotal rotation about the longitudinal axis of the lens 46. In a similar manner, the second lens cover end wall 78 includes a semi-circular slot 86 which is sized to fit over the shaft 58. It should be noted that when the lens cover 72 is in position over the lens 46, the first and second lens cover end walls 76, 78 are located in close proximity to the first and second lens ends walls 50, 52.

Further, as the lens cover 72 is pivoted relative to the lens 46, the slot 80 moves relative to the tab 82 whereby the pivotal movement of the lens cover 72 is limited as the tab 82 engages the ends of the slot 80.

Figure 6:
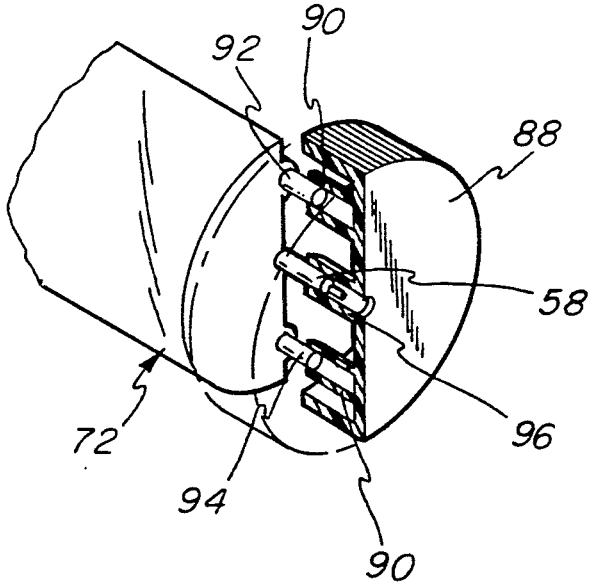
FIG. 6 is a partially cut-away perspective view showing the circular knob member partially inserted onto the lens cover.

A circular knob member 88 is mounted adjacent to the second lens cover end wall 78 and includes four uniformly spaced hollow mounting studs 90. As seen in FIG. 6, the second lens cover end wall 78 is formed with two diametrically opposed studs 92, 94 positioned to be received within two of the mounting posts 90 whereby the knob 88 may be used to rotate the lens cover 72 relative to the lens 46. It should be noted that the knob 88 is provided with an aperture 96 in the center thereof for permitting passage of the shaft 58 through the knob 88 and into engagement with the mounting slots 60 and 64. Further, the exterior of the knob 88 may be provided with a grooved exterior 98 to facilitate manual manipulation of the knob 88 to rotate the lens cover 72 about the lens 46.

As seen in FIG. 2, a backing plate 100 is located behind the battery holder 28 and attached at the rear side of the front housing portion 12. The backing plate 100 extends from the upper plate 18 to the lower plate 20 and spans between the end plates 22, 24.

The backing plate 100 includes an aperture 102 for receiving a fastener 104 attaching the backing plate 100 to the back of the battery holder and a pair of lower apertures 106 are provided for receiving fasteners 108 to attach the backing plate directly to mounting posts 110 formed integrally with the front housing portion 12.

A pair of keyhole apertures 112, 114 are formed on opposing sides of the upper edge of the backing plate 100. The keyhole apertures 112, 114 are adapted to receive a pair of fasteners extending horizontally from a vertical wall surface whereby the light 10 may be mounted to the wall. Specifically, the light 10 may be positioned with the enlarged portions of each of the keyhole apertures 112, 114 passing over the head of a respective fastener and subsequently, the light 10 may be moved downwardly to engage the narrow portions of the keyhole apertures 112, 114 with the shank portions of the fasteners whereby the light will be securely fastened to the wall.

The upper edge of the backing plate 100 is provided with a rear slider glide plate portion 116 and a corresponding front slider guide plate portion 118 is formed in the upper plate 18 of the front housing portion 12. The rear and front slider guide plate portions 116, 118 cooperate with each other to form a slot for positioning and guiding a slider 120. The slider 120 in turn is positioned to contact and actuates a slide member 122 of the switch 34 in sliding movement between first and second positions of the switch 34.

Figure 7:
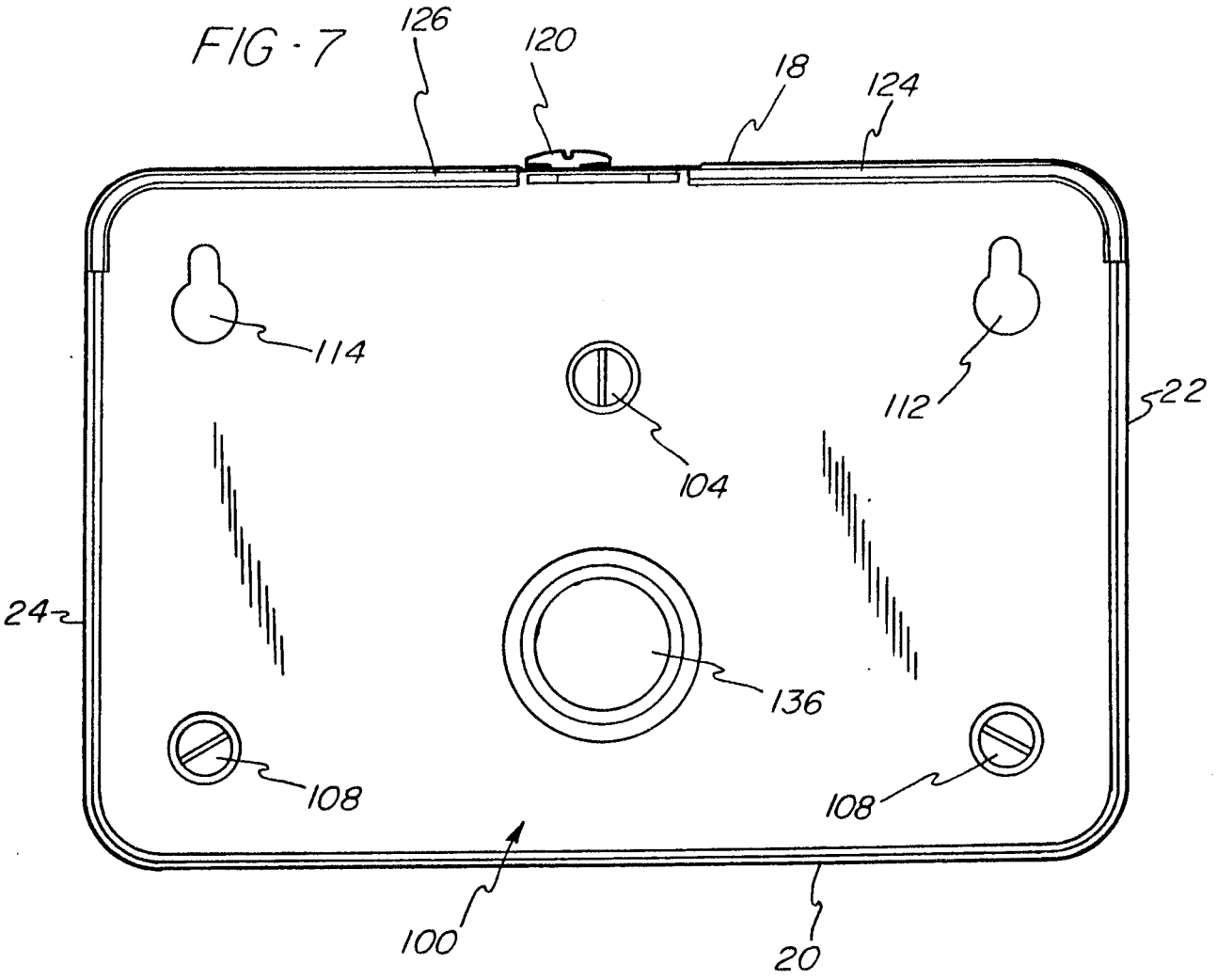
FIG. 7 is an elevational view of the rear face of the front housing assembly.

As may be seen in FIGS. 2 and 7, a portion of the upper edge of the backing plate 100 is cut away extending on either side of the slider guide plate 116 and down a portion of either side of the backing plate 100. With the backing plate in position at the rear of the front housing portion 12, a pair of slots 124, 126 are defined between the upper edge of the backing plate 100 and the inner surface of the upper plate 18. Further, the slots 124, 126 extend around the upper corners of the front housing portion 12 adjacent to at least an upper portion of each of the end plates 22, 24. Further, a centrally located slot 125 is defined beneath the rear slider guide plate portion 116 between the slots 124, 126.

Referring to FIGS. 2 and 3, the rear housing portion 14 is formed with a vertical extension 128 and a horizontal extension 130. The horizontal extension includes tongue portions 132, 133, 134 extending forwardly therefrom and corresponding substantially in size and shape to the slots 124, 125, 126 formed between the backing plate 100 and the front housing portion 12 and beneath the rear slider guide plate portion 116. The tongue portions 132, 133, 134 slidably engage in the slots 124, 125, 126 and act to guide the rear housing portion 14 into position relative to the front housing portion 12 whereby the light structure 10 shown in FIG. 1 is formed.

The backing plate 100 includes means defining a threaded aperture 136 therethrough for receiving and engaging the threads of a threaded fastener member 138. In addition, the rear housing portion 14 includes means defining an aperture 140 therethrough which aperture will be aligned with the aperture 136 and the backing plate 100 when the tongue portions 132, 133, 134 are engaged in the slots 124, 125, 126. It should be noted that the aperture 140 in the rear housing portion 14 is preferably not threaded such that the fastener member 138 may rotate freely within this aperture.

The fastener member 138 is preferably provided with a head portion 141 having flats on opposing sides to facilitate rotation thereof and operates to draw together and control the relative spacing between the front and rear housing portions 12, 14 when the light 10 is attached to a horizontal crib rail 16. Further, the vertical extension 128 of the rear housing portion 14 is provided with a forwardly extending flange 142 for engaging a surface of the crib rail 16 opposite from the backing plate 100 as well as for engaging vertical rails extending downwardly from the horizontal rails 16 when the fastener member 138 is operated to draw the housing portions 12, 14 together.

The horizontal extension 130 includes downwardly extending lip portions 146, 148 which are adapted to engage the upper surface of the crib rail 16 whereby downward movement of the light 10 relative to the crib rail 16 is prevented.

Figure 8:
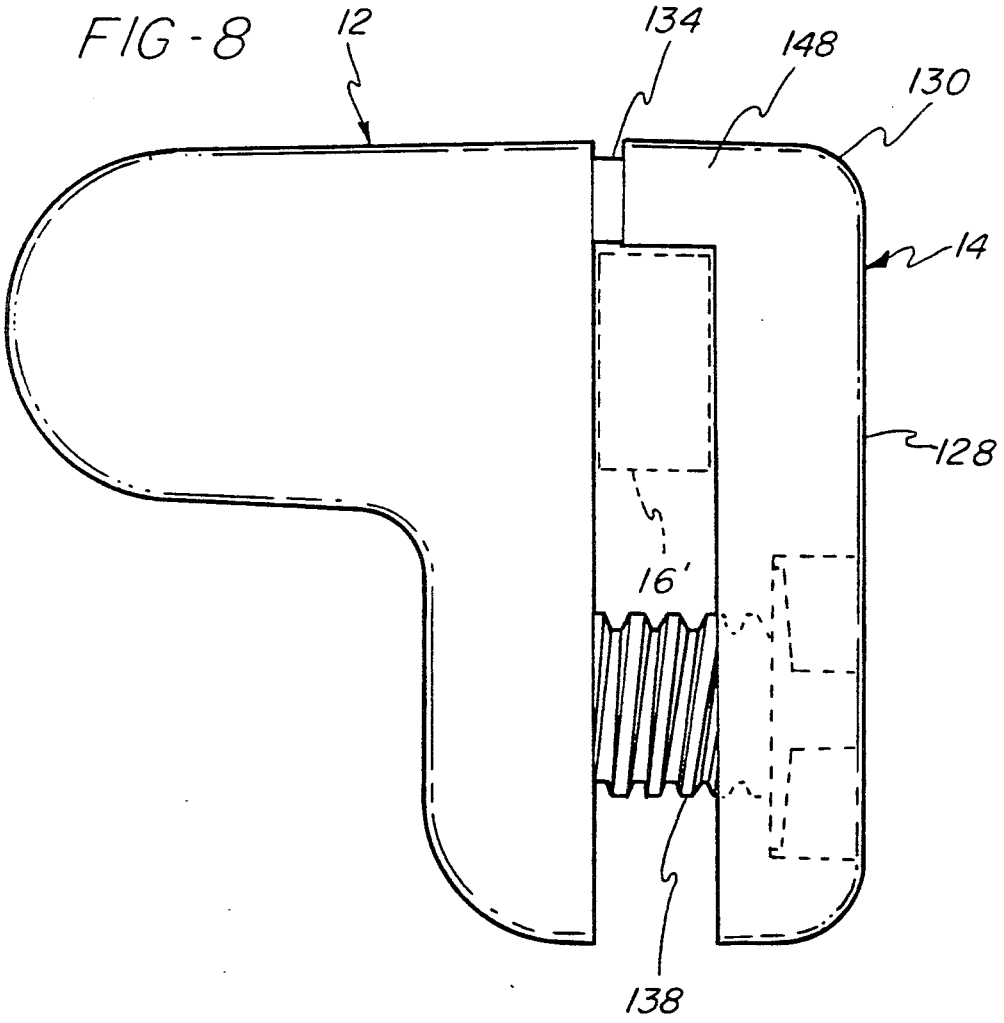
FIG. 8 is an elevational view of the crib light with the rear housing portion positioned outwardly from the front housing portion to accommodate a crib rail having an increased thickness.

Referring to FIG. 8, it can be seen that the present construction for mounting the crib light 10 provides for a certain degree of adjustability to accommodate crib rails having different thicknesses. In particular, in FIG. 8 it can be seen that the tongue portions 132, 133, 134 may only extend partially within the front housing portion 12 while still providing the necessary support to prevent the front housing portion 12 from separating from the crib rail 16'. In the preferred embodiment, the spacing between the front and rear housing portions 12, 14 is adjustable a sufficient amount to permit the light 10 to be mounted to crib rails varying in thickness from 13/16 inch to 1 inch.

It should be noted that one particular advantage of the present invention is that the rear housing portion 14 provides a clamping structure for effectively preventing downward movement of the light 10 relative to the crib rail 16 by providing a horizontal extension 130 for engaging the upper surface of a crib rail 16. Further, since the member 130 for engaging the upper surface of the crib rail 16 is formed on the removable rear housing portion 14, it is possible to remove this structure which is particularly adapted for engaging the crib rail in order to leave the planar backing plate 100 exposed for mounting the crib light 10 directly to a vertical wall surface. Thus, it should be apparent that the crib light 10 of the present invention is adapted to be mounted either to a horizontal crib rail or to a vertical wall surface since the clamping structure for attaching and preventing downward movement of the light 10 relative to the crib rail may be removed to provide for alternative mounting.

It should be further noted that the crib light 10 of the present invention is particularly well suited for use in child care environments requiring varying lighting conditions by virtue of the provision of the lens cover 72 at the light emitting aperture 26. The lens cover 72 may be rotated clockwise, as seen in FIG. 3, from a position which essentially fully covers the lens 46 and prevents emission of light therefrom to a position in which the cover 72 essentially provides completely unrestricted passage of light through the aperture 26 and lens 46. Further, the knob 88 provides a convenient means for manually controlling the brightness of the light through a continuous range from the position in which the aperture 26 is closed to the fully open position.

In use, the feature of varying the brightness of the light is particularly useful in child care environments since, under certain circumstances, a dim light is needed for checking on a sleeping child without waking the child whereas in other circumstances, a bright light is needed at the same location such as when changing the diaper of a child that is already awake.

Another feature which particularly facilitates the use of the present light in areas where children are present is a control circuit for automatically shutting the light off after it has been on for a predetermined period of time, such as five to ten minutes. When the switch 34 is moved from a first open circuit or off position to a second closed circuit or on position, electrical power will be conveyed from batteries located in the battery compartments 30, 32 to the light bulb 42 in a conventional manner. After a predetermined period of time, the control circuit 35, in the form of a conventional timing circuit, which is electrically connected to the switch 34 and light bulb 42 will open the circuit conveying power from the batteries to the light bulb 42 to thereby prevent the batteries from being depleted if the light should be inadvertently left on. This feature is particularly useful if a child should turn the light on while playing with the switch activating slider 120 since the control circuit 35 will automatically shut the light off and thereby conserve the batteries.

From the above description, it should be apparent that the present invention provides a crib light which is versatile in allowing the light to be either mounted on a crib or on a vertical wall surface. Further, the present light provides a means for adjusting the brightness of the light emitted such that varying lighting requirements are easily accommodated.

Finally, the present light provides means for conserving the battery energy source such that the light may be used for longer periods of time between battery changes.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. A light adapted to be mounted to a crib having a horizontally extending crib rail or to a vertical wall surface, said light comprising:

a front housing assembly defining a front and a rear side and including means for supporting a light source, a back plate portion located at said rear side of said front housing assembly, means defining a back plate aperture in said back plate portion, a rear housing portion for use in mounting said light to said crib rail, said rear housing portion including a horizontal extension for engaging said front housing assembly and a vertical extension extending substantially perpendicularly from said horizontal extension, means defining a clamping aperture in said vertical extension, and wherein said horizontal extension may be engaged with said front housing assembly and positioned in contact with an upper surface of said crib rail with said clamping aperture aligned with said back plate aperture such that a fastener may be positioned through said clamping aperture and said back plate aperture to draw said vertical extension of said rear housing toward said back plate portion and thereby hold said light in position on said crib rail.

2. The light of claim 1, including means defining additional apertures in said back plate portion for mounting said light to said vertical wall surface wherein said additional apertures have a key hole shape adapted to receive fasteners extending from said vertical wall surface.

3. The light of claim 1, wherein said vertical extension is positioned in spaced relation to said back plate portion when said horizontal extension is engaged with said front housing assembly.

4. The light of claim 1, wherein said rear housing portion includes a tongue portion, said tongue portion extending forwardly of said back plate portion and within said front housing assembly when said horizontal extension is engaged with said front housing assembly.

5. The light of claim 1, including a light source located within said front housing assembly, means defining a light aperture in said front housing assembly for permitting passage of light from said light source out of said front housing assembly and a lens cover located at said light aperture, said lens cover being movable relative to said light aperture such that movement of said lens cover operates to close and open said light aperture to control the brightness of light emitted from said front housing assembly.

6. The light of claim 5, including a lens positioned across said light aperture adjacent to said lens cover wherein said lens and said lens cover each define a half cylinder shape and said lens cover moves in pivotal movement about a longitudinal axis passing through a diametric center of said lens and said lens cover.

7. The light of claim 6, wherein said lens includes an end wall and said lens cover includes an end wall adjacent to said lens end wall, one of said end walls including means defining a semi-circular slot and the other of said end walls including a tab extending into said slot, said tab and slot cooperating to limit said movement of said lens cover.

8. The light of claim 1, including a light source, an electrical power source, a switch movable between first and second positions and a control circuit, said switch and control circuit operating to control passage of electrical power from said power source to said light source wherein positioning said switch in said first position prevents passage of electrical power to said light source and movement of said switch from said first to said second position results in passage of electrical power to said light source for a predetermined interval of time controlled by said control circuit.

9. The light of claim 1, wherein said back plate aperture is threaded and said fastener is threaded for engaging in said back plate aperture, said clamping aperture being defined by a smooth wall such that said fastener may freely rotate within said clamping aperture.

10. A light adapted to be mounted on a crib, said light comprising:

a front housing assembly defining a front and rear side and including a light source, means defining an aperture at said front side, a rear housing portion for use in mounting said light to a horizontal rail of a crib, a horizontal extension formed integrally with said rear housing portion for engaging said front housing assembly such that said horizontal extension forms a support for contacting an upper surface of said rail of said crib whereby said light is prevented from moving downwardly relative to said rail, a lens cover mounted at said aperture, said lens cover being movable between a plurality of positions whereby said lens cover operates to control the amount of light passing through said aperture, and a lens positioned across said light aperture adjacent to said lens cover wherein said lens and said lens cover each define a half cylinder shape and said lens cover moves in pivotal movement within said front housing assembly about a longitudinal axis passing through a diametric center of said lens and said lens cover.

11. The light of claim 10, wherein said lens includes an end wall and said lens cover includes an end wall adjacent to said lens end wall, one of said end walls including means defining a semi-circular slot and the other of said end walls including a tab extending into said slot, said tab and slot cooperating to limit said movement of said lens cover.

12. The light of claim 10, including an electrical power source, a switch movable between first and second positions and a control circuit, said switch and control circuit operating to control passage of electrical power from said power source to said light source wherein positioning said switch in said first position prevents passage of electrical power to said light source and movement of said switch from said first to said second position results in passage of electrical power to said light source for a predetermined interval of time controlled by said control circuit.

* * * * *